US006464749B1

(12) United States Patent
Kawase et al.

(10) Patent No.: US 6,464,749 B1
(45) Date of Patent: Oct. 15, 2002

(54) FE-BASED SINTERED VALVE SEAT HAVING HIGH STRENGTH AND METHOD FOR PRODUCING THE SAME

(75) Inventors: Kinya Kawase; Koichiro Morimoto, both of Tokyo (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/497,853

(22) Filed: Feb. 4, 2000

(30) Foreign Application Priority Data

Feb. 4, 1999 (JP) ..... 11-026954

(51) Int. Cl.[7] ..... C22C 33/02; C22C 38/16
(52) U.S. Cl. ..... 75/246
(58) Field of Search ..... 419/46; 75/246

(56) References Cited

U.S. PATENT DOCUMENTS 4,588,441 A * 5/1986 Ikenoue et al. ..... 75/230
4,648,903 A * 3/1987 Ikenoue et al. ..... 75/230
4,964,908 A * 10/1990 Greetham ..... 75/241
5,125,962 A * 6/1992 Krentscher ..... 75/247
5,911,949 A * 6/1999 Ninomiya et al. ..... 420/487

* cited by examiner

*Primary Examiner*—Daniel J. Jenkins
(74) *Attorney, Agent, or Firm*—Oblon, Spivak, McClelland, Maier & Neustadt, P.C.

(57) ABSTRACT

A valve seat made of an Fe-based sintered alloy excellent in wear resistance and having a reduced counterpart valve attack property is disclosed, which comprises a base comprising 15–40% by weight of Cu, 0.3–12% by weight of Ni and 0.0005–3.0% by weight of C, and further comprising 0.1–10% by weight of Co and 0.1–10% by weight of Cr when necessary, with the balance being Fe and inevitable impurities, the base having a structure which comprises an Fe-based alloy phase 1 composed of Fe as a main component combined by a Cu-based alloy phase 2 composed of Cu as a main component, wherein hard particles phase 3 having MHV of 500–1700 is dispersed in the base. The Fe-based alloy phase 1 is an Fe alloy phase which comprises Ni, Cu and C with Fe having more than 50% by weight, while the Cu-based alloy phase 2 is a Cu alloy phase which comprises Ni, Fe and C with Cu having more than 50% by weight. At the same time, the contents of Ni and C included in the Fe-based alloy phase are more than those of Ni and C included in the Cu-based alloy phase.

22 Claims, 2 Drawing Sheets x 1000

FE-BASED SINTERED VALVE SEAT HAVING HIGH STRENGTH AND METHOD FOR PRODUCING THE SAME

BACKGROUND OF THE INVENTION

1. Field of the Invention

The present invention relates to an Fe-based sintered alloy valve seat excellent in wear resistance and producing less wear on the valve counterpart of the valve seat.

2. Description of the Related Art

As the technology of sintering has progressed, it has become possible to mass produce various mechanical parts from sintered alloys with good dimensional accuracy. For example, sintered valve seats have been produced.

JP-A 3-158445 discloses a valve seat composed of an Fe-based sintering alloy. The structure of the valve seat is such that hard particles comprising 25–45% by weight of Cr, 20–30% by weight of W, 20–30% by weight of Co, 1–3% by weight of C, 0.2–2% by weight of Si and 0.2–2% by weight of Nb with the balance being Fe and inevitable impurities, and hard particles comprising 25–32% by weight of Mo, 7–10% by weight of Cr, 1.5–3.5% by weight of Si with the balance being Co and inevitable impurities are uniformly dispersed in an Fe-based alloy base in a total amount of 10–25% by weight, wherein the Fe-based alloy base comprises 1–3% by weight of Cr, 0.5–3% by weight of Mo, 0.5–3% by weight of Ni, 2–8 by weight of Co, 0.6–1.5% by weight of C and 0.2–1% by weight of Nb with the balance being Fe and inevitable impurities and has a structure mainly comprising a pearlite phase and a venite phase.

Recently, direct injection engines have been developed and put into practical use in which fuel is directly injected into the combustion chambers. To achieve high-performance, high fuel efficiency and downsizing, these engines have been operated under lean burn conditions by raising the air-fuel ratio. However, this has increased temperatures in the combustion chambers of the engines above those in conventional engines. At such high temperatures, conventional valve seats do not exhibit sufficient wear resistance. The high temperatures also lead to serious wear of the valves that are counterparts to the valve seats.

SUMMARY OF THE INVENTION

The present invention provides an Fe-based sintered alloy valve seat made of an Fe-based sintered alloy. In comparison with conventional valve seats, the Fe-based sintered alloy valve seat exhibits remarkable high strength and wear resistance. In addition, valve counterparts to the Fe-based sintered alloy valve seat exhibit remarkably less wear than valve counterparts of conventional valve seats.

The Fe-based sintered alloy in the Fe-based sintered alloy valve seat comprises a base comprising 15–40% by weight of Cu, 0.3–12% by weight of Ni and 0.0005–3.0% by weight of C with the balance being Fe and inevitable impurities. The Fe-based sintered alloy has a structure which comprises an Fe-based alloy phase composed of Fe as a main component combined by a Cu-based alloy phase composed of Cu as a main component, wherein a hard particle phase having Micro Hardness Vickers ("MHV") of 500–1700 is dispersed in the base in an amount of 5–30% by volume while surrounded by the Fe-based alloy phase.

When hard particles including Co and/or Cr are mixed with Fe powder and Cu—Ni alloy powder (or, mixed powder of Ni powder and Cu powder), and further with C powder when necessary, and then the mixed powder is pressed, followed by sintering, a part of Co and/or Cr included in the hard particles diffuses in the base obtained from the Fe powder and Cu—Ni alloy powder, including C powder when necessary, and a base is formed which comprises 15–40% by weight of Cu, 0.3–12% by weight of Ni, 0.0005–3.0% by weight of C, and 0.1–10% by weight of Co and/or 0.1–10% by weight of Cr.

Figure 1:
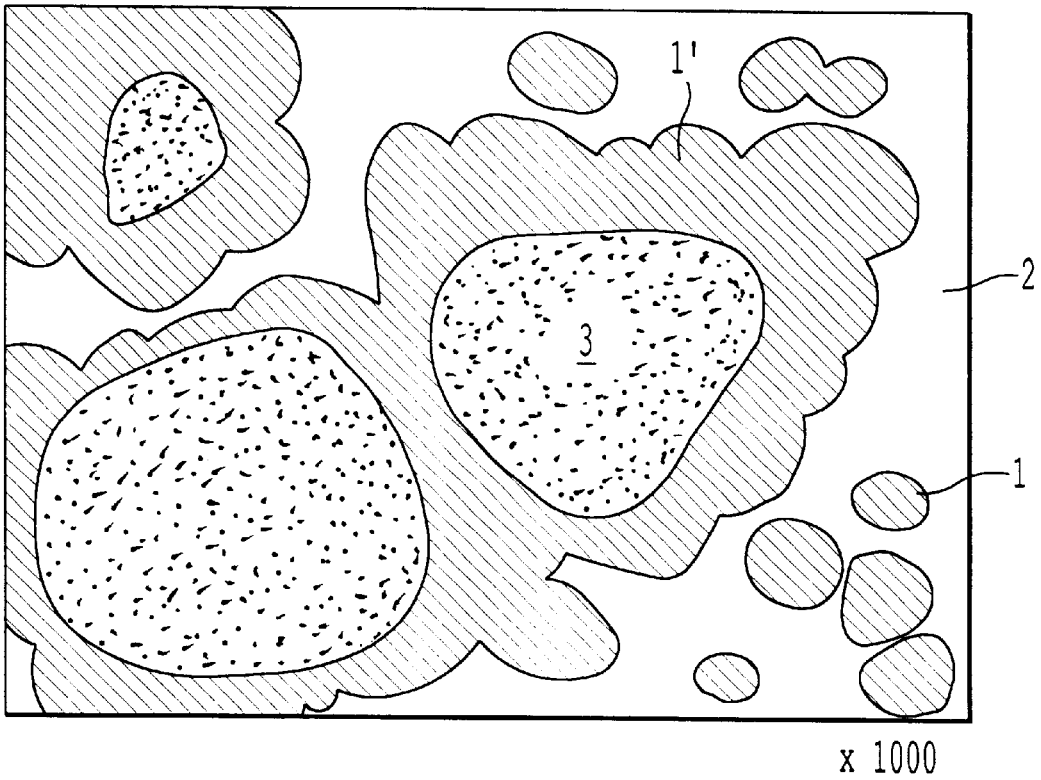
FIG. 1 shows the structure of a Fe-based sintered alloy valve seat of the present invention.

The symbols in the drawings have the following meanings:

1: Fe-based alloy phase

1': Fe-based alloy phase having a petal-like section

2: Cu-based alloy phase

3: Hard particle phase

DESCRIPTION OF PREFERRED EMBODIMENTS

According to the present invention, a valve seat is made of an Fe-based sintered alloy comprising a base which comprises 15–40% by weight of Cu, 0.3–12% by weight of Ni and 0.0005–3.0% by weight of C with the balance being Fe and inevitable impurities, and has a structure which comprises an Fe-based alloy phase composed of Fe as a main component combined by a Cu-based alloy phase composed of Cu as a main component, wherein hard particle phase having MHV of 500–1700 is dispersed in the base in an amount of 5–30% by volume while surrounded by the Fe-based alloy phase.

In embodiments, the Fe-based sintered alloy surrounding the hard particle phase can have a petal-like section. By "petal-like section" it is meant that the interface between the Fe-based sintered alloy and the base material is more irregular than the interface between the Fe-based sintered alloy and each hard particle.

The valve seat can include 0.1–10% by weight of Co. 0.1–10% by weight of Cr, or both.

In embodiments, the hard particle phase can comprise a Mo—Fe alloy including Mo and Fe as main components. For example, when a hard powder comprising a Mo-based alloy is added as hard particles and sintered, the Mo-based alloy comprising 10–50% by weight of Fe with the balance being Mo, Mo included in the hard powder hardly diffuses in the base during sintering. Therefore, a base is formed which comprises 15–40% by weight of Cu, 0.3–12% by weight of Ni and 0.0005–3.0% by weight of C with the balance being Fe and inevitable impurities, and has a structure comprising an Fe-based alloy phase composed of Fe as a main component combined by a Cu-based alloy phase composed of Cu as a main component, while a hard particle phase comprising a Mo-based alloy is formed in the formed base, the formed hard particle phase including 10–50% by weight of Fe, and further including 0.01–5% by weight of Ni, 0.01–5% by weight of Cu and 0.1–3% by weight of C coming from the base by diffusion, and having MHV of 500–1700.

In embodiments, the hard particle phase can comprise a Co—Fe alloy including Co and Fe as main components. For example, when a hard powder comprising Co-based alloy is added as hard particles and sintered, the Co-based alloy comprising 10–50% by weight of Fe with the balance being Co, Co included in the hard powder diffuses in the base during sintering. Therefore, a base is formed which comprises 15–40% by weight of Cu, 0.3–12% by weight of Ni, 0.0005–3.0% by weight of C and 0.1–10% by weight of Co with the balance being Fe and inevitable impurities, and has a structure comprising an Fe-based alloy phase composed of Fe as a main component combined by a Cu-based alloy phase composed of Cu as a main component, while a hard particle phase comprising a Co-based alloy is formed in the formed base, the formed hard particle phase including 10–50% by weight of Fe, and further including 0.01–5% by weight of Ni, 0.01–5% by weight of Cu and 0.1–3% by weight of C coming from the base by diffusion, and having MHV of 500–1700.

In embodiments, the hard particle phase can comprise a Ni alloy including Ni, Cr and Mo as main components. For example, when a hard powder comprising Ni-based alloy is added as the hard particles and sintered, the Ni-based alloy comprising 10–40% by weight of Cr and 5–25% by weight of Mo with the balance being Ni, Cr included in the hard powder diffuses in the base during sintering, while Mo included in the hard powder hardly diffuses in the base during sintering. Therefore, a base is formed which comprises 15–40% by weight of Cu, 0.3–12% by weight of Ni, 0.0005–3.0% by weight of C and 0.1–10% by weight of Cr with the balance being Fe and inevitable impurities, and has a structure comprising an Fe-based alloy phase composed of Fe as a main component combined by a Cu-based alloy phase composed of Cu as a main component, while a hard particle phase comprising a Ni-based alloy is formed in the formed base, the formed hard particle phase including 10–40% by weight of Cr and 5–25% by weight of Mo, and further including 2–20% by weight of Fe, 0.01–10% by weight of Cu and 0.1–3% by weight of C coming from the base by diffusion, and having MHV of 500–1700.

In embodiments, the hard particle phase can comprise a Co—Mo—Cr—Si alloy including Co, Mo, Cr and Si as main components. For example, when a hard powder comprising Co-based alloy is added as the hard particles and sintered, the Co-based alloy comprising 15–35% by weight of Mo, %, 2–13% by weight of Cr and 0.5–5% by weight of Si with the balance being Co, Co and Cr included in the hard powder diffuse in the base during sintering, while Mo included in the hard powder hardly diffuses in the base during sintering. Therefore, a base is formed which comprises 15–40% by weight of Cu, 0.3–12% by weight of Ni, 0.0005–3.0% by weight of C, 0.1–10% by weight of Co and 0.1–10% by weight of Cr with the balance being Fe and inevitable impurities, and has a structure comprising an Fe-based alloy phase composed of Fe as a main component combined by a Cu-based alloy phase composed of Cu as a main component, while a hard particle phase comprising a Co-based alloy is formed in the formed base, the formed hard particle phase including 15–35% by weight of Mo, 2–13% by weight of Cr and 0.5–5% by weight of Si, and further including 0.01–5% by weight of Ni, 0.01–5% by weight of Cu, 2–20% by weight of Fe and 0.1–3% by weight of C coming from the base by diffusion, and having MHV of 500–1700.

In embodiments, the hard particle phase can comprise an Fe—Cr—W—Co—C—Si—Nb alloy including Fe, Cr, W, Co, C, Si and Nb as main components. For example, when a hard powder comprising Fe-based alloy is added as the hard particles and sintered, the Fe-based alloy comprising 5–40% by weight of Cr, %, 15–30% by weight of W %, 5–30% by weight of Co, 0.1–3% by weight of C, 0.1–3% by weight of Si and 0.1–3% by weight of Nb with the balance being Fe, Co and Cr included in the hard powder diffuse in the base during sintering. Therefore, a base is formed which comprises 15–40% by weight of Cu, 0.3–12% by weight of Ni, 0.0005–3.0% by weight of C, 0.1–10% by weight of Co and 0.1–10% by weight of Cr with the balance being Fe and inevitable impurities, and has a structure comprising an Fe-based alloy phase composed of Fe as a main component combined by a Cu-based alloy phase composed of Cu as a main component, while a hard particle phase comprising an alloy is formed in the formed base, the formed hard particle phase of the alloy including 5–40% by weight of Cr, 15–30% by weight of W, 5–30% by weight of Co, 0.1–3% by weight of C, 0.1–3% by weight of Si and 0.1–3% by weight of Nb, and further including 0.01–8% by weight of Ni, 0.01–8% by weight of Cu coming from the base by diffusion, and having MHV of 500–1700.

In embodiments, the hard particle phase can comprise an Fe—Cr—Mo—Co—C—Si—Nb alloy including Fe, Cr, Mo, Co, C, Si and Nb as main components. For example, when a hard powder comprising Fe-based alloy is added as the hard particles and sintered, the Fe-based alloy comprising 5–40% by weight of Cr, 15–30% by weight of Mo, 5–30% by weight of Co, 0.1–3% by weight of C, 0.1–3% by weight of Si and 0.1–3% by weight of Nb with the balance being Fe, Co and Cr included in the hard powder diffuse in the base during sintering. Therefore, a base is formed which comprises 15–40% by weight of Cu, 0.3–12% by weight of Ni, 0.0005–3.0% by weight of C, 0.1–10% by weight of Co and 0.1–10% by weight of Cr with the balance being Fe and inevitable impurities, and has a structure comprising an Fe-based alloy phase composed of Fe as a main component combined by a Cu-based alloy phase composed of Cu as a main component, while a hard particle phase comprising an alloy is formed in the formed base, the formed hard particle phase of the alloy including 5–40% by weight of Cr, 15–30% by weight of Mo, 5–30% by weight of Co, 0.1–3% by weight of C, 0.1–3% by weight of Si and 0.1–3% by weight of Nb, and further including 0.01–8% by weight of Ni, 0.01–8% by weight of Cu coming from the base by diffusion, and having MHV of 500–1700.

In embodiments, the hard particle phase having MHV of 500–1700 can be a mixture of at least two hard particle alloy phases.

The hard particle phase dispersed in the base of the Fe-based sintered alloy valve seat is preferable with in the range of MHV of 500–1700 and it is more preferable that the hard particle phase is selected from any one of hard particle phases having MHV of 500–1000, MHV of 800–1700 and a mixture of MHV 500–1000 and 800–1700 according to a material of valve of the counterpart thereof.

For examples, when the material of valve of the counterpart is austenitic heat-resistant steels such as SUH35, SUH36 and the like, it is more preferable that the hard particle phase dispersed in the Fe-base sintered alloy valve seat is a hard particle phase having MHV of 500–1000. When the material of valve of the counterpart is martensitic heat-resistant steels such as SUH3, SUH11 and the like, it is more preferable that the hard particle phase dispersed in the Fe-base sintered alloy valve seat is a hard particle phase having MHV of 800–1700. For still another example, when the face material of valve of the counterpart is a facing composed of Co-based heat-resistant alloy, it is more preferable that the hard particle phase dispersed in the Fe-base sintered alloy valve seat is a mixed phase of hard particle phases each having MHV of 500–1000 and MHV of 800–1700.

In embodiments, the Fe-based alloy phase, which constitutes the base of the Fe-based sintered alloy valve seat and is composed of Fe as a main component, is an Fe alloy phase comprising Ni Cu, C, further comprising components coming from the hard particle phase by diffusion and comprising Fe having more than 50% by weight, while the Cu-based alloy phase, which is composed of Cu as a main component, is a Cu alloy phase comprising Ni, Fe and C with Cu having more than 50% by weight. At the same time, the contents of Ni and C included in the Fe-based alloy phase is more than those of Ni and C included in the Cu-based alloy phase.

Therefore, in embodiments, the Fe-based sintered alloy valve of the present invention is characterized in that the Fe-based alloy phase, which constitutes a base of a Fe-based sintered alloy valve seat and is composed of Fe as a main component, is an Fe alloy phase comprising Ni, Cu, C, further comprising components coming from the hard particle phase by diffusion and comprising Fe having more than 50% by weight, while the Cu-based alloy phase, which combines the Fe alloy phase and is composed of Cu as a main component, is a Cu alloy phase comprising Ni, Fe, C, further comprising components coming from the hard particle phase by diffusion and comprising Cu having more than 50% by weight; and at the same time, the contents of Ni and C included in the Fe-based alloy phase is more than those of Ni and C included in the Cu-based alloy phase.

The Fe-based sintered alloy valve seat of the present invention is made by a process comprising the steps of: preparing raw powders including Fe powder, Cu—Ni alloy powder, Cu powder and Ni powder, and further C powder when necessary, and hard powder having MHV of 500–1700; mixing the above-mentioned powders at a prescribed ratio and then mixing by double-cone mixer the mixed powder with zinc stearate which is a lubricant in the following process of die-mold pressing; pressing the mixed powder including the zinc stearate to a green compact; and sintering the green compact at a temperature of 1100–1300° C. under a nitrogen atmosphere including hydrogen. The sintering temperature is more preferably 1090–1200° C.

In the method for malting the valve seat of the present invention, though the element powders of Cu powder and Ni powder can be used as raw powders, Cu—Ni alloy powder is more preferable in place of the Cu powder and Ni powder. The reason why is considered due to a sintering mechanism as mentioned below. That is, when the Cu—Ni alloy powder is used, a lot of Cu liquid phase is not generated at a stretch even if the temperature is raised up to the solid-liquid area of the Cu—Ni alloy in the initial stage of sintering, but the sintering proceeds mildly without deformation of the sintered compact such as strain and deflection. In the middle stage of sintering, Ni in the Cu—Ni powder diffuses in the Fe powder because of having a high affinity with Fe. As Cu solubility in Fe becomes large with the increase of Ni content in the Fe powder with the result that the diffusion of Cu into Fe becomes active and the close contactivity between Fe and Cu is enhanced. In the late stage of sintering, as Ni content in the Cu—Ni alloy is already decreased, the melting point of the Cu—Ni alloy powder lowers with the result that a lot of liquid generates at a stretch and a dynamic phase sintering proceeds. Further, the strain and deflection of the sintered compact are not caused by the lot of liquid which generates at a stretch as the late stage follows the sufficient sintering proceeding.

As the sintering mechanism of the Fe-based sintered alloy valve seat of the present invention is estimated as mentioned above in case of using Cu—Ni alloy powder as the raw material powder, it is preferable that Cu—Ni alloy powder (mother alloy powder having 1–25% by weight of Ni with the balance being Cu and inevitable impurities) is specifically used as a raw powder which is used for maling the Fe-based sintered alloy valve seat of the present invention.

The above-mentioned mechanism is concerned with forming the base of the Fe-based sintered alloy valve seat of the present invention, while the hard powder having MHV of 500–1700 does not melt during sintering and keeps the same shape as that of the raw material, and the hard powder having MHV of 500–1700 adsorbs to the Fe powder in the surroundings of the hard powder during sintering and the Fe powder forms a structure in which the Fe-based alloy disperses in such a state that the Fe-based alloy having a petal-like section (a half dumpling-shaped in three dimensions) surrounds the hard particle phase. The Fe-based alloy having such a petal-like section increases a contact area to the Cu-based alloy and increase a bond strength between the Fe-based alloy and Cu-based alloy more than conventionally.

The MHV of the hard particle phase dispersed in the base of the Fe-base sintered alloy valve seat is defined to 500–1700. This is because a hard particle phase having MHV of lower than 500 is not preferable as a sufficient wear resistance is not available and a hard particle phase having MHV of higher than 1700 is not preferable due to increasing excessively an amount of wear of the counterpart valve. Next, a hard particle phase dispersed in the Fe-based alloy in an amount of less than 5% by volume is not preferable as a sufficient wear resistance is not available and a hard particle phase dispersing in the Fe-based alloy in an amount of more than 30% by volume is also not preferable as the excessive existence of the hard particle phase brings about an insufficient toughness of the alloy. Therefore, an amount of the dispersing hard particle phase is defined to 5–30% by volume, and more preferably is 8–25% by volume. As Fe, Cu, Ni and C which are the components of the base diffuse into the above-mentioned hard particle phase, a very small amount of Fe, Cu, Ni and C are included in the hard particle phase.

The base has a composition which comprises 15–40% by weight of Cu, 0.3–12% by weight of Ni and 0.0005–3.0% by weight of C, and further comprising elements which have diffused from the hard powder including the elements according the necessary, with the balance being Fe and inevitable impurities, and has a structure which comprises an Fe-based alloy phase composed of Fe as a main component combined by a Cu-based alloy phase composed of Cu as a main component. The reason why the composition is defined as mentioned-above is as follows:

Cu has effects to raise density, strength and wear resistance. However, if the content of Cu is less than 15% by weight, liquid generation is not enough to provide the effects on the density, strength and wear resistance. On the other hand, if the content of Cu is more than 40% by weight, the liquid generation is excess with the result of causing an unfavorable deformation during sintering to bring about a big distribution of measurements. Therefore, the Cu content is defined to 15–40% by weight, and more preferably is 17–30% by weight, and most preferable is 20–28% by weight.

Ni has effects to raise a melting point of Cu alloy phase in a Cu alloy to control liquid sintering, and to raise the strength and toughness of Fe-alloy phase. However, if the content of Ni is less than 0.3% by weight, the effects are not sufficient. On the other hand, if the content of Ni is more than 12% by weight, the effects are not enhanced. Therefore, the Ni content is defined to 0.3–12% by weight, and more preferably is 2–6% by weight.

C has effects to reduce the raw Fe powder and enhance sintering, and to raise strength and hardness. However, if the content of C is less than 0.0005% by weight, the effects are not sufficient. On the other hand, if the content of C is more than 3.0% by weight, it is not preferable as toughness degreases. Therefore, the C content is defined to 0.0005–3.0% by weight, and more preferably is 0.05–1.6% by weight.

The base of the Fe-base sintered alloy valve seat comprises 15–40% by weight of Cu, 0.3–12% by weight of Ni and 0.0005–3.0% by weight of C with the balance being Fe and inevitable impurities, and has a structure which comprises an Fe-based alloy phase composed of Fe as a main component combined by a Cu-based alloy phase composed of Cu as a main component. There are cases that components of the hard particle are included in the Fe-based alloy and Cu-base alloy as a result of diffusion of the components. The Fe-based alloy phase surrounding the hard particle phase more preferably has a petallike section (a half-dumpling shape in three dimensions). This shape of the petal-like section provides an increase in the contact area between the Fe-based phase and Cu-base phase, thereby to provide a stronger bond strength.

EXAMPLES

The following raw powders are prepared: Fe powder having a mean particle size of 55 μm; Cu—Ni alloy powders a–e each having a composition and a mean particle size shown in Table 1; Cu powder having a mean particle size of 11 μm; Ni powder having a mean particle size of 10 μm; and C powder having a mean particle size of 18 μm. Further, hard powder A–F are prepared each having a composition shown in Table 2.

TABLE 1

| | | Mean particle size (μm) | Composition (wt. %) Ni | Cu |
|---|---|---|---|---|
| Cu-Ni alloy powder | a | 10 | 1.5 | Bal. |
| | b | 10 | 4 | Bal. |
| | c | 12 | 10 | Bal. |
| | d | 10 | 19 | Bal. |
| | e | 11 | 24 | Bal. |

TABLE 2

| | | Composition (wt. %) |
|---|---|---|
| Hard powder | A | Co: 60, Mo: 29, Cr: 8, Si: 3 |
| | B | Ni: 50, Cr: 30, Mo: 20 |
| | C | Mo: 65, Fe: 35 |
| | D | Fe: 50, Co: 50 |
| | E | Cr: 35, W: 25, Co: 25; C: 1, Si: 1, Nb: 1, Bal.: Fe |
| | F | Cr: 35, Mo: 25, Co: 25; C: 1, Si: 1, Nb: 1, Bal.: Fe |

Example 1

Mixed raw powders are prepared by mixing the above-mentioned Fe powder, Cu—Ni alloy powders a–e in Table 1, C powder and hard powders A–F in Table 2 according to a combination and proportion shown in Table 3, and further zinc stearate which is a lubricant in the following die-mold pressing is added to each mixed raw powder in an amount of 0.8% by weight relative to the mixed raw powder and mixed therewith, followed by pressing to make green compacts having a shape of valve seat and a dimension of (outside diameter: 34 mm)×(inside diameter: 27 mm)×(thickness: 7 mm).

The green compacts are sintered under a mixed atmosphere of N2–5% H2, at a temperature of 1140° C. for 20 minutes, thereby to make the Fe-based sintered alloy valve seats of the present invention (hereinafter, referred to as valve seat(s) of the present invention) 1–16 and the Fe-based sintered alloy valve seats of comparative samples (hereinafter, referred to as comparative valve seats) 1–6, respectively. With regard to each valve seat of the present invention and the comparative samples, the composition of base, and the amount of dispersion of hard particle phase and MHV thereof were measured and the results are shown in Tables 4–5.

The amount of dispersion of hard phase is obtained by measuring an area ratio of the hard particle by image analysis, followed by converting the measured area ratio to a volume ratio. The MHV of the hard particle phase was obtained by Micro Vickers Hardness measurement.

Figure 2:
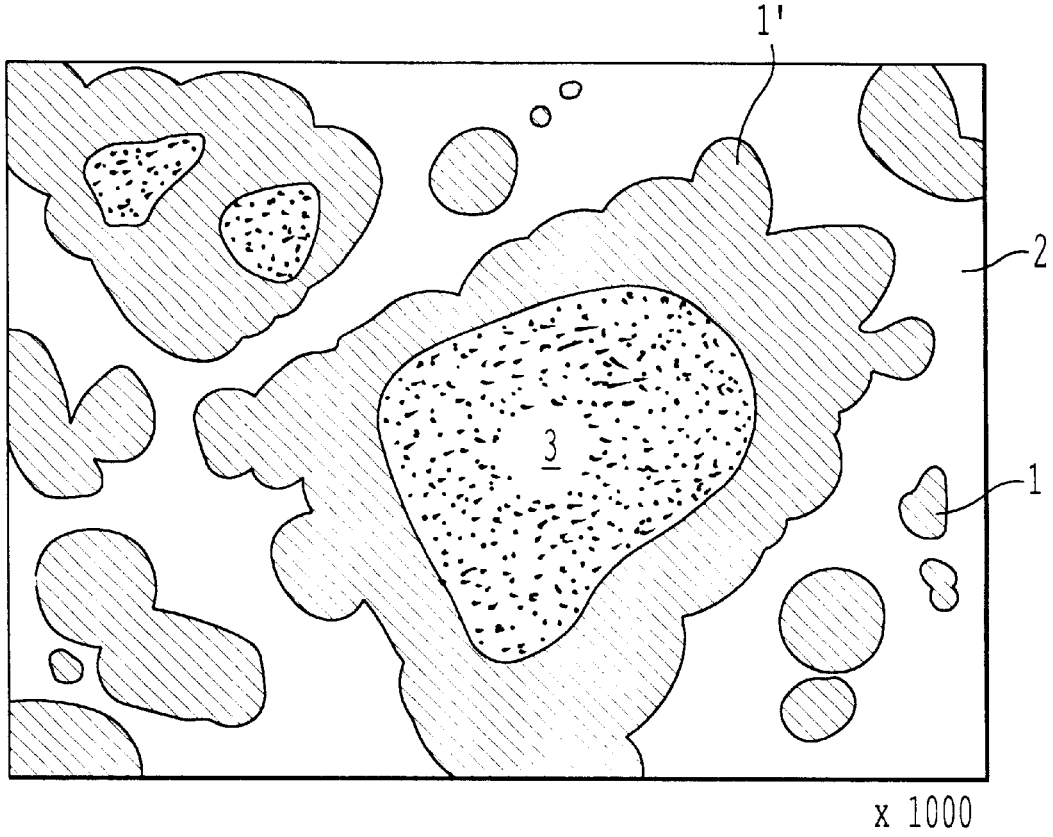
FIG. 2 shows the structure of another Fe-based sintered alloy valve seat of the present invention.

The valve seat No.1 of the present invention thus made is cut and polished, followed by metallographic observation by metallurgical microscope. The sketch obtained is shown in FIG. 1 in which hard particle phases were focused. In FIG. 1, 1 shows Fe-based alloy phase, 2 shows Cu-based phase and 3 shows hard particle phase formed by hard powder A. Further, the valve seat No.3 of the present invention was cut and polished, followed by metallographic observation by metallurgical microscope. The sketch obtained was shown in FIG. 2 in which hard particle phases were focused. In FIG. 2, 1 shows Fe-based alloy phase, 2 shows Cu-based phase and 3 shows hard particle phase formed by hard powder C. As is clear from the sketches of metal structure shown in FIGS. 1 and 2, the valve seats No. 1 and No.3 of the present invention comprise bases having Fe-based phase 1 combined by Cu-based phase 2, and hard particle phase 3 dispersed in the bases and having MHV of 500–1700 is surrounded by Fe-based phase 1' having a petal-like section (a half-dumpling shape in three dimensions). Further, the valve seats No.2 and Nos.4–14 of the present invention are observed on whether or not the Fe-based alloy phase 1' having a petal-like section (a half-dumpling shape in three dimensions) exists in the bases thereof, the results of which are shown in Tables 4 and 5.

Still further, the compositions are measured by EPMA, which are concerned with the Fe-based alloy phases and Cu-based alloy phases constituting the structures of the valve seats No.1 and No.3. As a result, it is confirmed that the Fe-based alloy phases included Ni, Cu and C with Fe having an amount of more than 50% by weight and the Cu-based alloy phases included Ni, Fe and C with Cu having an amount of more than 50% by weight, and the contents of Ni and C included in the Fe-based alloy phases are more than those included in the Cu-based alloy phases, respectively. It is also confirmed that a part of components of hard particle phases diffused into the Fe-based alloy phases and Cu-alloy phases, while a part of Fe, Cu, Ni and C diffused into the hard particle phases.

Still further, there are prepared a conventional Fe-based sintered alloy valve seat composed of Fe-based sintered alloy (hereinafter, referred to as conventional valve seat) having such a structure that hard particles A and E in Table 2 are uniformly dispersed in a total amount of 17% by weight in a base having an Fe-based alloy structure, wherein the base comprises 2% by weight of Cr, 1.5% by weight of Mo, 1.5% by weight of Ni, 5% by weight of Co, 1% by weight of C and 0.6% by weight of Nb with the balance being Fe and inevitable impurities and has a structure mainly comprising pearlite phase and venite phase.

With regard to the valve seats Nos.1–16 of the present invention, comparative valve seats Nos.1–6 and the conventional valve seat, the following wear tests are carried out.

Valves are prepared, each comprising a material of SUH36 and having a bevel part of an outside diameter of 30 mm, and the bevel part of each valve is kept at a temperature of 900° C., and then each of the valve seats Nos.1–16 of the present invention, the comparative valve seats Nos.1–6 and the conventional valve seat is enforced into a tool the interior of which was cooled by water, and next, each valve seat is tested under a gasoline atmosphere, at a valve-seated load of 30 Kg, at a valve-seated cycle of 3000/minute for 150 hours. After the test, the maximum amounts of wear of each valve seat and valve are measured, the results of which are shown in Tables 4 and 5.

As is clear from the results shown in Tables 3–5, the valve seats Nos.1–16 of the present invention exhibit less maximum amounts of wear of valve seat itself and less maximum amounts of wear of counterpart valve thereof as compared with the comparative valve seats Nos.1–6 and the conventional valve seat. It is also found that the comparative valve seats Nos.1–6 having the compositions which are not within the range of the present invention exhibit unfavorable values with regard to at least one of maximum amounts of wear of valve seat and maximum amounts of wear of counterpart valve.

TABLE 3

| Valve seat | | Mixed raw powder Mixed composition (wt. %) | | | |
|---|---|---|---|---|---|
| | | Hard powder | Cu-Ni alloy powder | C powder | Fe powder |
| The present invention | 1 | A: 15 | c: 17 | 0.3 | Bal. |
| | 2 | B: 20 | c: 28 | 0.3 | Bal. |
| | 3 | C: 24 | c: 33 | 0.3 | Bal. |
| | 4 | D: 25 | c: 36 | 0.3 | Bal. |
| | 5 | E: 29 | c: 39 | 0.3 | Bal. |
| | 6 | F: 10 | b: 41 | 0.3 | Bal. |
| | 7 | A: 7 | a: 24 | 0.3 | Bal. |
| | 8 | B: 15 | d: 37 | 0.3 | Bal. |
| | 9 | C: 15 | e: 38 | 0.3 | Bal. |
| | 10 | D: 15 | d: 35 | 0.3 | Bal. |
| | 11 | E: 15 | e: 47 | 0.3 | Bal. |
| | 12 | F: 15 | c: 25 | 0.8 | Bal. |
| | 13 | C: 15 | c: 25 | None | Bal. |
| | 14 | F: 15 | c: 25 | 0.6 | Bal. |
| | 15 | C: 15 | c: 25 | 0.05 | Bal. |
| | 16 | A: 5<br>C: 10<br>F: 5 | c: 25 | 0.05 | Bal. |
| Comparative | 1 | F: 15 | c: 15 | 0.3 | Bal. |
| | 2 | A: 15 | b: 43 | 0.3 | Bal. |
| | 3 | B: 15 | c: 53 | 0.3 | Bal. |
| | 4 | C: 15 | c: 25 | 1.0 | Bal. |
| | 5 | E: 4 | c: 25 | 0.3 | Bal. |
| | 6 | E: 38 | c: 25 | 0.3 | Bal. |
| Conventional valve seat | | | | | |

TABLE 4

| Valve seat | Composition of base (wt. %) | | | | | | Hard particle phase in base | | Presence of Fe-based alloy phase having a petal-like section | Maximum wear of valve seat (μm) | Maximum wear of valve (μm) |
|---|---|---|---|---|---|---|---|---|---|---|---|
| | Cu | Ni | C | Co | Cr | Fe | Vol. % | MHV | | | |
| The present invention | | | | | | | | | | | |
| 1 | 15.1 | 1.7 | 0.21 | 2.1 | 0.3 | Bal. | 14 | 731 | Yes | 16 | 11 |
| 2 | 24.8 | 3.3 | 0.18 | — | 1.4 | Bal. | 15 | 845 | Yes | 15 | 11 |
| 3 | 29.4 | 3.2 | 0.22 | — | — | Bal. | 26 | 1301 | Yes | 9 | 13 |
| 4 | 32.0 | 3.3 | 0.20 | 3.1 | — | Bal. | 18 | 543 | Yes | 15 | 17 |
| 5 | 34.4 | 3.4 | 0.36 | 1.5 | 2.5 | Bal. | 28 | 1198 | Yes | 5 | 16 |
| 6 | 39.2 | 1.3 | 0.29 | 0.5 | 1.2 | Bal. | 9 | 1295 | Yes | 16 | 8 |
| 7 | 23.5 | 0.4 | 0.21 | 1.0 | 0.1 | Bal. | 6 | 764 | Yes | 15 | 12 |
| 8 | 29.8 | 8.0 | 0.22 | — | 1.3 | Bal. | 17 | 895 | Yes | 9 | 9 |
| 9 | 29.0 | 9.2 | 0.18 | — | — | Bal. | 12 | 1395 | Yes | 10 | 13 |
| 10 | 27.1 | 6.5 | 0.20 | 2.8 | — | Bal. | 14 | 505 | Yes | 17 | 12 |
| 11 | 34.8 | 10.9 | 0.31 | 1.3 | 2.0 | Bal. | 11 | 1342 | Yes | 10 | 9 |
| 12 | 21.8 | 2.1 | 0.79 | 1.4 | 1.6 | Bal. | 16 | 1058 | Yes | 16 | 10 |
| 13 | 22.4 | 2.4 | 0.0009 | — | — | Bal. | 17 | 1459 | Yes | 12 | 8 |
| 14 | 22.5 | 2.3 | 0.66 | 1.5 | 0.4 | Bal. | 10 | 1288 | Yes | 18 | 9 |
| 15 | 22.7 | 2.5 | 0.005 | — | — | Bal. | 13 | 1465 | Yes | 14 | 10 |
| 16 | 22.2 | 2.3 | 0.08 | 1.3 | 0.4 | Bal. | 17 | 1596 | Yes | 7 | 7 |

TABLE 5

| Valve seat | Composition of base (wt. %) | | | | | | Hard particle phase in base | | Presence of Fe-based alloy phase having a petal-like section | Maximum wear of valve seat (μm) | Maximum wear of valve (μm) |
|---|---|---|---|---|---|---|---|---|---|---|---|
| | Cu | Ni | C | Co | Cr | Fe | Vol. % | MHV | | | |
| Comparative | | | | | | | | | | | |
| 1 | *13.1 | 1.4 | 0.36 | 0.9 | 1.2 | Bal. | 10 | 1118 | No | 49 | 36 |
| 2 | *41.4 | 1.7 | 0.21 | 1.3 | 0.2 | Bal. | 16 | 692 | Yes | 32 | 32 |
| 3 | 40.0 | *14.11 | 0.21 | — | 1.1 | Bal. | 14 | 845 | Yes | 27 | 28 |

TABLE 5-continued

| Valve seat | Composition of base (wt. %) Cu | Ni | C | Co | Cr | Fe | Hard particle phase in base Vol. % | MHV | Presence of Fe-based alloy phase having a petal-like section | Maximum wear of valve seat (μm) | Maximum wear of valve (μm) |
|---|---|---|---|---|---|---|---|---|---|---|---|
| 4 | 22.5 | 2.5 | *0.91 | — | — | Bal. | 11 | 1351 | Yes | 33 | 19 |
| 5 | 22.4 | 2.1 | 0.26 | 0.2 | 0.3 | Bal. | *3 | 1208 | Yes | 36 | 28 |
| 6 | 21.5 | 1.9 | 0.61 | 1.4 | 4.1 | Bal. | *35 | 1395 | Yes | 38 | 35 |
| Conventional valve seat | | | | | | | | | No | 135 | 129 |

(*value indicated is not within the range of the conditions of the present invention)

Example 2

Mixed powders for forming bases having compositions in Table 6 are prepared by mixing Fe powder, Cu powder, Ni powder and C powder all of which are element powders, and hard powders A–F for forming hard particles are added to the mixed powders for forming bases and mixed therewith according to a combination and proportion shown in Table 6, thereby to prepare mixed raw powders, and further zinc stearate which was a lubricant in the following die-mold pressing is added to each mixed raw powder in an amount of 0.8% by weight relative to the mixed raw powder and mixed therewith, followed by pressing to make green compacts having a shape of valve seat and a dimension of outside diameter: 34 mm inside diameter: 27 mm thickness: 7 mm.

The green compacts are sintered under a mixed atmosphere of N2–5% H2, at a temperature of 1140° C. for 20 minutes, thereby to make the Fe-based sintered alloy valve seats Nos.17–22 of the present invention having bases and hard particle phases comprising compositions shown in Table 7.

The valve seats Nos. 17–22 of the present invention are cut and polished, followed by metallographic observation by metallurgical microscope. As a result, it is found that the structures of No.17–22 are similar to the structures of Example 1 which were made using Cu—Ni alloy powders and hard particle phases were dispersed with being surrounded by Fe-based phases each having a petal-like section. However, amounts of Fe-based alloy phase of valve seats Nos.17–22 having a petallike section are somewhat small as compared with the structures of Example 1 which were made using Cu—Ni alloy powder. Further, the compositions are measured by EPMA, which are concerned with the Fe-based alloy phases and Cu-based alloy phases constituting the structures of the valve seats Nos.17–22. As a result, it is confirmed that the Fe-based alloy phases included Ni, Cu and C with Fe having an amount of more than 50% by weight and the Cu-based alloy phases included Ni, Fe and C with Cu having an amount of more than 50% by weight, and the contents of Ni and C included in the Fe-based alloy phases are more than those included in the Cu-based alloy phases, respectively. It is also confirmed that a part of components of hard particle phases is included in the Fe-based alloy phases and Cu-alloy phases by diffusion thereof, while Fe, Cu, Ni and C are included in the hard particle phases by diffusion thereof.

With regard to the valve seats Nos.17–22 of the present invention thus obtained, the wear tests are carried out under the same condition as in the Example 1, and the maximum amounts of wear of each valve seat and counterpart valve are measured, the results of which are shown in Table 7.

TABLE 6

| Valve seat | | Mixed raw powder Mixed composition (wt. %) Hard powder | Cu powder | Ni powder | C powder | Fe powder |
|---|---|---|---|---|---|---|
| The present invention | 17 | A: 7 | 15.0 | 1.5 | 0.3 | Bal. |
| | 18 | B: 15 | 25.0 | 2.8 | 0.3 | Bal. |
| | 19 | C: 15 | 29.5 | 3.3 | 0.3 | Bal. |
| | 20 | D: 15 | 28.5 | 6.5 | 0.3 | Bal. |
| | 21 | E: 15 | 35.0 | 3.8 | 0.3 | Bal. |
| | 22 | F: 7<br>B: 8 | 39.5 | 1.5 | 0.3 | Bal. |

TABLE 7

| Valve seat | Composition of base (wt. %) Cu | Ni | C | Co | Cr | Fe | Hard particle phase in base Vol. % | MHV | Presence of Fe-based alloy phase having a petal-like section | Maximum wear of valve seat (μm) | Maximum wear of valve (μm) |
|---|---|---|---|---|---|---|---|---|---|---|---|
| The present invention | | | | | | | | | | | |
| 17 | 15.1 | 1.5 | 0.20 | 1.2 | 0.4 | Bal. | 7 | 1185 | Yes | 19 | 16 |
| 18 | 25.0 | 3.6 | 0.17 | — | 1.4 | Bal. | 15 | 952 | Yes | 15 | 17 |
| 19 | 29.6 | 3.2 | 0.21 | — | — | Bal. | 12 | 1091 | Yes | 18 | 19 |
| 20 | 28.1 | 6.1 | 0.23 | 2.1 | — | Bal. | 14 | 1250 | Yes | 18 | 21 |
| 21 | 35.2 | 3.9 | 0.22 | 0.9 | 1.3 | Bal. | 11 | 1481 | Yes | 20 | 20 |
| 22 | 39.6 | 2.0 | 0.21 | 0.9 | 1.3 | Bal. | 12 | 1598 | Yes | 19 | 21 |

As is clear from the results shown in Tables 6 and 7, the valve seats Nos.17–22 exhibit less maximum amounts of wear of valve seat itself and counterpart valve thereof as compared with the conventional valve seat which was prepared in Example 1.

Example 3

Mixed raw powders are prepared by mixing above-mentioned Fe powder, Cu—Ni alloy powders a–e in Table 1, C powder and hard powders A–F in Table 2 according to a combination and proportion shown in Table 8. Zinc stearate is added to each mixed raw powder in the same manner as in Example 1, followed by pressing to make green compacts having a shape of valve seat and sintering the green compacts in the same manner as in Example 1, thereby to make the Fe-based sintered alloy valve seats of the present invention (hereinafter, referred to as valve seat(s) of the present invention) Nos.23–38 and the Fe-based sintered alloy valve seats of comparative samples (hereinafter, referred to as comparative valve seats) Nos.7–12, respectively. With regard to each valve seat of the present invention and the comparative samples, the composition of base, and the amount of dispersion of hard particle phase and MHV thereof are measured in the same manner as in Example 1, the results of which are shown in Tables 9–10.

The valve seats No.23 and No.25 of the present invention thus made are cut and polished, followed by metallographic observation by metallurgical microscope in the same manner as in Example 1. As the result, it is found that the valve seats No.23 and No.25 of the present invention comprise bases having Fe-based phase 1 combined by Cu-based phase 2, and hard particle phase 3 dispersing in the bases and having MHV of 500–1700 is surrounded by Fe-based phase 1' having a petal-like section (a half-dumpling shape in three dimensions). Further, the valve seats No.24 and Nos. 26–38 of the present invention and the comparative valve seats No.7–12 are observed on whether or not the Fe-based alloy phase 1' having a petal-like section (a half-dumpling shape in three dimensions) exists in the bases thereof, the results of which are shown in Tables 9 and 10.

Still further, the compositions are measured by EPMA, which are concerned with the Fe-based alloy phases and Cu-based alloy phases constituting the structures of the valve seats No.23 and No.25. As a result, it is confirmed that the Fe-based alloy phases included Ni, Cu and C with Fe having an amount of more than 50% by weight and the Cu-based alloy phases included Ni, Fe and C with Cu having an amount of more than 50% by weight, and the contents of Ni and C included in the Fe-based alloy phases are more than those included in the Cu-based alloy phases, respectively. It is also confirmed that a part of components of hard particle phases diffused into the Fe-based alloy phases and Cu-alloy phases, while a part of Fe, Cu, Ni and C diffused into the hard particle phases.

With regard to the valve seats Nos.23–38 of the present invention and the comparative valve seats Nos.7–12, wear tests are carried out in the same manner as in Example 1, the results of which are shown in Tables 9 and 10. In addition, the test result on the conventional valve seat which is shown in Example 1 is again shown in Table 10.

TABLE 8

| Valve seat | | Mixed raw powder Mixed composition (wt. %) Hard powder | Cu-Ni powder | C powder | Fe powder |
|---|---|---|---|---|---|
| The present invention | 23 | A: 15 | c: 17 | 1.3 | Bal. |
| | 24 | B: 20 | c: 28 | 1.5 | Bal. |
| | 25 | C: 24 | c: 33 | 1.3 | Bal. |
| | 26 | D: 25 | c: 36 | 1.3 | Bal. |
| | 27 | E: 29 | c: 39 | 1.4 | Bal. |
| | 28 | F: 10 | b: 41 | 1.3 | Bal. |
| | 29 | A: 7 | a: 24 | 1.7 | Bal. |
| | 30 | B: 15 | d: 37 | 1.6 | Bal. |
| | 31 | C: 15 | e: 38 | 1.3 | Bal. |
| | 32 | D: 15 | d: 35 | 1.5 | Bal. |
| | 33 | E: 15 | e: 47 | 1.6 | Bal. |
| | 34 | F: 15 | c: 25 | 1.0 | Bal. |
| | 35 | C: 15 | c: 25 | 2.2 | Bal. |
| | 36 | F: 15 | c: 25 | 1.0 | Bal. |
| | 37 | C: 15 | c: 25 | 3.2 | Bal. |
| | 38 | A: 5 | c: 25 | 1.5 | Bal. |
| | | C: 10 | | | |
| | | F: 5 | | | |
| Comparative | 7 | F: 15 | c: 15 | 1.3 | Bal. |
| | 8 | A: 15 | b: 43 | 1.3 | Bal. |
| | 9 | B: 15 | c: 53 | 1.4 | Bal. |
| | 10 | C: 15 | c: 25 | 3.5 | Bal. |
| | 11 | E: 4 | c: 25 | 1.3 | Bal. |
| | 12 | E: 38 | c: 25 | 1.3 | Bal. |
| | | Conventional valve seat | | | |

TABLE 9

| Valve seat | Composition of base (wt. %) Cu | Ni | C | Co | Cr | Fe | Hard particle phase in base Vol. % | MHV | Presence of Fe-based alloy phase having a petal-like section | Maximum wear of valve seat (μm) | Maximum wear of valve (μm) |
|---|---|---|---|---|---|---|---|---|---|---|---|
| The present invention | | | | | | | | | | | |
| 23 | 15.3 | 1.7 | 1.2 | 2.1 | 0.3 | Bal. | 12 | 760 | Yes | 18 | 13 |
| 24 | 25.0 | 3.2 | 1.3 | — | 1.5 | Bal. | 17 | 856 | Yes | 14 | 14 |
| 25 | 29.4 | 3.3 | 1.2 | — | — | Bal. | 24 | 1245 | Yes | 10 | 16 |
| 26 | 31.9 | 3.4 | 1.2 | 3.1 | — | Bal. | 20 | 525 | Yes | 17 | 17 |
| 27 | 34.4 | 3.3 | 1.3 | 1.6 | 2.6 | Bal. | 28 | 1268 | Yes | 6 | 18 |
| 28 | 39.4 | 1.3 | 1.2 | 0.6 | 1.1 | Bal. | 8 | 1340 | Yes | 15 | 10 |
| 29 | 23.4 | 0.4 | 1.5 | 1.1 | 0.1 | Bal. | 6 | 815 | Yes | 18 | 8 |
| 30 | 29.9 | 8.1 | 1.4 | — | 1.3 | Bal. | 14 | 1021 | Yes | 11 | 10 |
| 31 | 29.0 | 9.0 | 1.2 | — | — | Bal. | 14 | 1523 | Yes | 12 | 12 |
| 32 | 27.3 | 6.5 | 1.4 | 2.8 | — | Bal. | 12 | 511 | Yes | 18 | 16 |
| 33 | 35.0 | 10.8 | 1.4 | 1.5 | 1.9 | Bal. | 13 | 1296 | Yes | 9 | 13 |

TABLE 9-continued

| Valve seat | Composition of base (wt. %) Cu | Ni | C | Co | Cr | Fe | Hard particle phase in base Vol. % | MHV | Presence of Fe-based alloy phase having a petal-like section | Maximum wear of valve seat (μm) | Maximum wear of valve (μm) |
|---|---|---|---|---|---|---|---|---|---|---|---|
| 34 | 21.6 | 2.0 | 0.8 | 1.4 | 1.7 | Bal. | 14 | 1185 | Yes | 14 | 10 |
| 35 | 22.5 | 2.5 | 2.0 | — | — | Bal. | 14 | 1263 | Yes | 13 | 13 |
| 36 | 22.5 | 2.3 | 2.4 | 1.3 | 0.4 | Bal. | 13 | 1380 | Yes | 16 | 14 |
| 37 | 22.5 | 2.4 | 2.9 | — | — | Bal. | 14 | 1265 | Yes | 18 | 12 |
| 38 | 22.2 | 2.2 | 1.4 | 1.2 | 0.4 | Bal. | 18 | 1438 | Yes | 8 | 8 |

TABLE 10

| Valve seat | Composition of base (wt. %) Cu | Ni | C | Co | Cr | Fe | Hard particle phase in base Vol. % | MHV | Presence of Fe-based alloy phase having a petal-like section | Maximum wear of valve seat (μm) | Maximum wear of valve (μm) |
|---|---|---|---|---|---|---|---|---|---|---|---|
| Comparative | | | | | | | | | | | |
| 7 | *13.1 | 1.3 | 1.2 | 0.8 | 1.3 | Bal. | 13 | 1208 | No | 46 | 32 |
| 8 | *41.3 | 1.7 | 1.2 | 1.3 | 0.2 | Bal. | 14 | 783 | Yes | 28 | 26 |
| 9 | 40.0 | *14.0 | 1.3 | — | 1.1 | Bal. | 12 | 805 | Yes | 27 | 31 |
| 10 | 22.5 | 2.6 | *3.1 | — | — | Bal. | 14 | 1423 | Yes | 29 | 14 |
| 11 | 22.3 | 2.1 | 1.2 | 0.2 | 0.3 | Bal. | *3 | 1336 | Yes | 39 | 24 |
| 12 | 21.6 | 1.8 | 1.2 | 1.3 | 4.2 | Bal. | *35 | 1278 | Yes | 32 | 36 |
| Conventional valve seat | | | | | | | | | No | 135 | 129 |

(*value indicated is not within the range of the conditions of the present invention)

As is clear from the results shown in Tables 9–10, the valve seats 23–38 of the present invention exhibit less maximum amounts of wear of valve seat itself and less maximum amounts of wear of counterpart valve thereof as compared with the conventional valve seat. It is also found that the comparative valve seats 7–12 having the compositions which are not within the range of the present invention exhibit unfavorable values with regard to at least one of maximum amounts of wear of valve seat and maximum amounts of wear of counterpart valve.

Example 4

Mixed powders for forming bases having compositions in Table 11 are prepared by mixing Fe powder, Cu powder, Ni powder and C powder all of which are element powders, and hard powders A–F for forming hard particles are added to the mixed powders for forming bases and mixed therewith according to a combination and proportion shown in Table 11, thereby to prepare mixed raw powders. Zinc stearate is added to each mixed raw powder in the same manner as in Example 1, followed by pressing to make green compacts having a shape of valve seat and sintering the green compacts in the same manner as in Example 1, thereby to make the Fe-based sintered alloy valve seats of the present invention (hereinafter, referred to as valve seat(s) of the present invention) Nos.39–44. With regard to each valve seat of the present invention, the composition of base, and the amount of dispersion of hard particle phase and MHV thereof are measured in the same manner as in Example 1, the results of which are shown in Tables 12.

The valve seats Nos.39–44 of the present invention are cut and polished, followed by metallographic observation by metallurgical microscope. As a result, it is found that the structures of No.39–44 are similar to the structures of Example 3 which were made using Cu—Ni alloy powders and hard particle phases are dispersed with being surrounded by Fe-based phases each having a petal-like section. However, amounts of Fe-based alloy phase of valve seats 39–44 having a petallike section are somewhat small as compared with the structures of Example 3 which are made using Cu—Ni alloy powder. Further, the compositions are measured by EPMA, which are concerned with the Fe-based alloy phases and Cu-based alloy phases constituting the structures of the valve seats Nos.39–44. As a result, it is confirmed that the Fe-based alloy phases included Ni, Cu and C with Fe having an amount of more than 50% by weight and the Cu-based alloy phases included Ni, Fe and C with Cu having an amount of more than 50% by weight, and the contents of Ni and C included in the Fe-based alloy phases are more than those included in the Cu-based alloy phases, respectively. It is also confirmed that a part of components of hard particle phases is included in the Fe-based alloy phases and Cu-alloy phases by diffusion thereof, while Fe, Cu, Ni and C are included in the hard particle phases by diffusion thereof.

With regard to the valve seats Nos.39–44 of the present invention thus obtained, wear tests are carried out under the same condition as in the Example 1, and the maximum amounts of wear of each valve seat and counterpart valve are measured, the results of which are shown in Table 12.

As is clear from the results shown in Tables 12, the valve seats Nos.39–44 exhibit less maximum amounts of wear of valve seat itself and counterpart valve thereof as compared with the conventional valve seat which was prepared in Example 1.

TABLE 11

| Valve seat | | Mixed raw powder Mixed composition (wt. %) Hard powder | Cu powder | Ni powder | C powder | Fe powder |
|---|---|---|---|---|---|---|
| The present invention | 39 | A: 7 | 15.0 | 1.5 | 1.3 | Bal. |
| | 40 | B: 15 | 25.0 | 2.8 | 1.5 | Bal. |
| | 41 | C: 15 | 29.5 | 3.3 | 1.3 | Bal. |
| | 42 | D: 15 | 28.5 | 6.5 | 1.5 | Bal. |
| | 43 | E: 15 | 35.0 | 3.8 | 1.4 | Bal. |
| | 44 | F: 7<br>B: 8 | 39.5 | 1.5 | 1.3 | Bal. |

TABLE 12

| Valve seat | Composition of base (wt. %) Cu | Ni | C | Co | Cr | Fe | Hard particle phase in base Vol. % | MHV | Presence of Fe-based alloy phase having a petal-like section | Maximum wear of valve seat (μm) | Maximum wear of valve (μm) |
|---|---|---|---|---|---|---|---|---|---|---|---|
| The present invention | | | | | | | | | | | |
| 39 | 15.1 | 1.5 | 1.2 | 1.3 | 0.4 | Bal. | 6 | 1265 | Yes | 20 | 17 |
| 40 | 25.1 | 3.7 | 1.3 | — | 1.3 | Bal. | 12 | 808 | Yes | 18 | 18 |
| 41 | 29.6 | 3.3 | 1.2 | — | — | Bal. | 14 | 923 | Yes | 19 | 18 |
| 42 | 27.9 | 6.2 | 1.3 | 2.1 | — | Bal. | 11 | 1386 | Yes | 22 | 24 |
| 43 | 35.2 | 3.8 | 1.3 | 0.9 | 1.2 | Bal. | 13 | 1208 | Yes | 21 | 22 |
| 44 | 39.7 | 1.9 | 1.2 | 0.9 | 1.3 | Bal. | 13 | 1431 | Yes | 21 | 19 |

As mentioned-above, the Fe-based sintered alloy valve seat of the present invention exhibits a small amount of wear thereof and moreover has a small offensive property to a valve which is the counterpart of the valve seat. Therefor, the valve seat of the present invention can greatly contribute to a development of the automotive industry in the field of engines and the like.

The disclosure of Japanese Patent Application No. 10-327868, filed Nov. 18, 1998, and of the priority document, Japanese Patent Application No. 11-026954, filed Feb. 4, 1999, is incorporated by reference herein in its entirety.

What is claimed is:

1. A valve seat including an alloy comprising a base material, and

5–30% by volume of particles dispersed in the base material, wherein the base material comprises 15–40% by weight of Cu, 0.3–12% by weight of Ni, 0.0005–3.0% by weight of C, and a balance of Fe and inevitable impurities; the base material comprises an iron alloy phase containing Fe as a main component, and a copper alloy phase containing Cu as a main component; each of the particles is surrounded by the iron alloy phase; and each of the particles has a MHV of 500–1700.

2. The valve seat according to claim 1, wherein an interface between the iron alloy phase and the base material is more irregular than an interface between the iron alloy phase and each of the particles.

3. The valve seat according to claim 1, wherein the base further comprises 0.1–10% by weight of Co.

4. The valve seat according to claim 1, wherein the base further comprises 0.1–10% by weight of Cr.

5. The valve seat according to claim 1, wherein the base further comprises 0.1–10% by weight of Co and 0.1–10% by weight of Cr.

6. The valve seat according to claim 1, wherein the particles comprise a Mo—Fe alloy including Mo and Fe as main components.

7. The valve seat according to claim 1, wherein the particles comprise a Co—Fe alloy including Co and Fe as main components.

8. The valve seat according to claim 1, wherein the particles comprise a Ni—Cr—Mo alloy including Ni, Cr and Mo as main components.

9. The valve seat according to claim 1, wherein the particles comprise a Co—Mo—Cr—Si alloy including Co, Mo, Cr and Si as main components.

10. The valve seat according to claim 1, wherein the particles comprise a Fe—Cr—W—Co—C—Si—Nb alloy including Fe, Cr, W, Co, C, Si and Nb as main components.

11. The valve seat according to claim 1, wherein the particles comprise a Fe—Cr—Mo—Co—C—Si—Nb alloy including Fe, Cr, Mo, Co, C, Si and Nb as main components.

12. The valve seat according to claim 1, wherein the particles comprise a mixture of at least two alloys.

13. A alloy comprising a base material, and

5–30% by volume of particles dispersed in the base material, wherein the base material comprises 15–40% by weight of Cu, 0.3–12% by weight of Ni, 0.0005–3.0% by weight of C, and a balance of Fe and inevitable impurities; the base material comprises an iron alloy phase containing Fe as a main component, and a copper alloy phase containing Cu as a main component; each of the particles is surrounded by the iron alloy phase; and each of the particles has a MHV of 500–1700.

14. The alloy according to claim 13, wherein an interface between the iron alloy phase and the base material is more irregular than an interface between the iron alloy phase and each of the particles.

15. The alloy according to claim 13, wherein the base further comprises 0.1–10% by weight of Co.

16. The alloy according to claim 13, wherein the base further comprises 0.1–10% by weight of Cr.

17. The alloy according to claim 13, wherein the base further comprises 0.1–10% by weight of Co and 0.1–10% by weight of Cr.

18. The valve seat according to claim 1, wherein the base material comprises 2.1–12% by weight of Ni.

19. The alloy according to claim 13, wherein the base material comprises 2.1–12% by weight of Ni.

20. A method of making a valve seat, the method comprising:

mixing raw powders of Fe, Ni-Cu alloy and hard powder, and optionally C, to form a mixed powder;

pressing the mixed powder to obtain a green compact;

sintering the green compact; and producing the valve seat of claim 1.

21. A method of making a valve seat, the method comprising:

mixing raw powders of Fe, Ni, Cu and hard powder, and optionally C, to form a mixed powder;

pressing the mixed powder to obtain a green compact;

sintering the green compact; and producing the valve seat of claim 1.

22. A method of making an alloy, the method comprising:

mixing Cu, Ni, C and Fe; and producing the alloy of claim 15.

* * * * *